United States Patent [19]

Wyant

[11] 4,076,351

[45] Feb. 28, 1978

[54] UP-DOWN CABINET

[76] Inventor: Hobart Dale Wyant, 5303 Delaware, Wichita, Kans. 67204

[21] Appl. No.: 678,131

[22] Filed: Apr. 19, 1976

[51] Int. Cl.[2] ..... A47B 67/02

[52] U.S. Cl. ..... 312/247; 312/325; 312/319; 248/280

[58] Field of Search ..... 312/247, 302, 325, 319; 248/280, 281

[56] References Cited

U.S. PATENT DOCUMENTS

| | | | |
|---|---|---|---|
| 527,629 | 10/1894 | Traut | 312/247 |
| 2,473,239 | 6/1949 | Boyd | 312/325 X |
| 2,681,263 | 6/1954 | Angelillo | 312/319 X |
| 2,866,101 | 12/1958 | Wagner et al. | 248/280 X |
| 2,910,335 | 10/1959 | Wales | 312/247 |

*Primary Examiner*—Paul R. Gilliam
*Assistant Examiner*—Victor N. Sakran
*Attorney, Agent, or Firm*—Edwin H. Crabtree; John H. Widdowson

[57] ABSTRACT

An up-down cabinet for lowering a cabinet from a wall so that easy access is provided to the cabinet. The cabinet is normally disposed adjacent the wall. By urging the cabinet away from the wall the cabinet pivots outwardly and downwardly on pivotally attached swing arms. The swing arms are attached to cables resting on cable pulleys. The cables are held in tension by coil springs. By applying tension on the cables the cabinet is easily retracted upwardly and rearwardly to its normal position against the wall.

1 Claim, 4 Drawing Figures

UP-DOWN CABINET

BACKGROUND OF THE INVENTION

This invention relates generally to cabinets, cabinet housings, and cabinet shelves and more particularly but not by way of limitation to an apparatus used in lowering and retracting a cabinet housing.

Heretofore there have been a number of different types of cabinets having swingable shelves. The shelves are mounted on arms that pivot and allow the shelf to be moved outwardly and downwardly from the cabinet housing.

Also there are various types of bens, containers, receptacles, etc. that are pivotally mounted on arms having springs attached thereto for biasing the arms to a retracted position.

None of the prior art cabinets disclose the novel combination of the up-down cabinet as described herein.

SUMMARY OF THE INVENTION

The up-down cabinet provides a cabinet housing that can be quickly urged outwardly and downwardly for easy access to the cabinet housings.

The subject invention is biased in its normal position against the wall by coil springs. When the cabinet is lowered the tension on the springs is increased thereby aiding the user of the cabinet in returning the cabinet to its retracted position.

The up-down cabinet allows the entire cabinet housing to be lowered rather than individual cabinet shelves.

Through the use of cables and cable pulleys coacting with the coil springs and swing arms a greater mechanical advantage is provided in lowering and retracting the up-down cabinet.

The up-down cabinet includes a cabinet housing disposed adjacent a wall. Assembly plates are attached to the wall and are disposed on each side of the cabinet housing. A pair of vertically mounted swing arms are attached to each assembly plate and each side of the cabinet housing for pivoting the housing outwardly and downwardly. Attached to the swing arms are cables mounted on cable pulleys. The cables are attached to coil springs mounted to the assembly plates.

The advantages and objects of the invention will become evident from the following detailed description when read in conjunction with the accompanying drawings which illustrate the preferred embodiments of the invention.

DETAILED DESCRIPTION OF THE DRAWINGS

Figure 1:
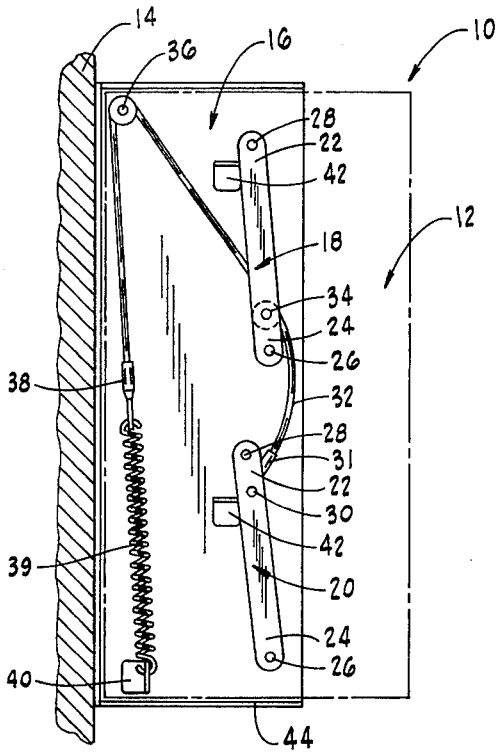
FIG. 1 is a side view of the up-down cabinet with the cabinet housing in a retracted position against the wall.

In FIG. 1 the up-down cabinet is designated by general reference numeral 10. The cabinet 10 includes a cabinet housing 12 shown in dashed lines and in a retracted position against a wall 14. The cabinet housing 12 is pivotally attached to assembly plates 16 by an upper swing arm 18 and a lower swing arm 20. While it cannot be seen in FIG. 1 the up-down cabinet 10 includes an identical assembly plate 16 mounted on the opposite side of the cabinet housing 12 and including the following described apparatus.

The upper swing arm 18 and lower swing arm 20 include an upper end portion 22 and a lower end portion 24. The lower end portion 24 is pivotally connected to the cabinet housing 12 by a pivot pin 26. The upper end portion 22 is pivotally connected to the assembly plates 16 by a pivot pin 28. Attached to the lower swing arm 20 and between the pivot pins 26 and 28 is a cable pivot pin 30 attached to a cable pivot 31. The cable pivot 31 is attached to one end of a cable 32. The cable 32 rides on a cable pulley 34 mounted between the pivot pins 26 and 28 on the upper swing arm 18. From the cable pulley 34 the cable 32 is looped over a similar cable pulley 36 mounted to the top of the assembly plate 16. From the cable pulley 36 the cable 32 is looped downward and connected to a spring eye 38. The cable 32 is held in tension by a vertically disposed coil spring 39. The coil spring 39 is connected at one end to the spring eye 38 and the other end to a spring mounting plate 40. The spring mounting plate 40 is attached to the bottom of the assembly plate 16. When the cabinet housing 12 is in a retracted position the upper swing arm 18 and the lower swing arm 20 rest against stops 42.

Figure 2:
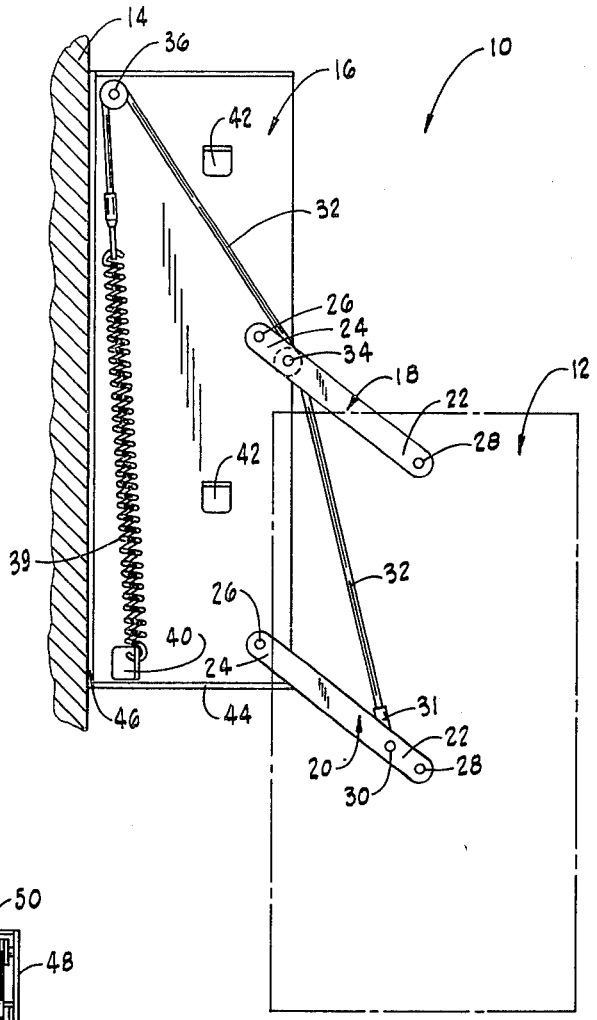
FIG. 2 is a side view of the up-down cabinet with the cabinet housing in a lowered position.

In FIG. 2 the cabinet housing 12 is shown in its lowered position. This position is obtained by urging the housing 12 outwardly and downwardly. During this operation the housing 12 pivots on the upper swing arm 18 and lower swing arm 20. The housing 12 is lowered until the lower swing arm 20 comes to rest against a lower flange portion 44 of the assembly plates 16. As the cabinet housing 12 is lowered the cable 32 connected to the lower swing arm 20 moves downward rotating on the cable pulleys 34 and 36 and urging the coil spring 39 upward thereby increasing the tension on the coil spring 39. Due to the weight of the cabinet housing 12 the tension of the coil spring 39 is overcome and the housing 12 remains in its lowered position. When it is desired to retract the housing 12 it is urged upward and rearward and with the help of the spring tension the cabinet housing 12 is easily returned to its original position against the wall 14.

Figure 3:
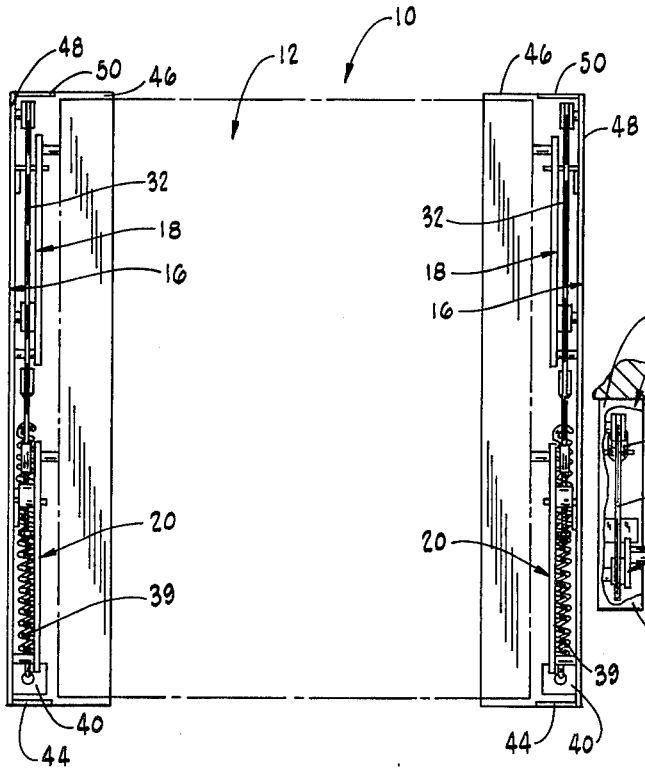
FIG. 3 is a front view of the up-down cabinet with the cabinet housing in a retracted position.

FIG. 3 illustrates a front view of the cabinet housing 12 with the assembly plates 16 mounted on both sides of the housing 12. The assembly plates 16 are L-shaped having a first side portion 46 which is attached to the wall 14 and a second side position 48 which is used for mounting the swing arms 18 and 20, the pulley 36, and the spring mounting plate 40. As seen in FIG. 3 the second side portion 48 acts as a housing to shield the swing arms 18 and 20, the pulleys 34 and 36, cables 32, and spring 39 from view when looking at the sides of the housing 12.

Figure 4:
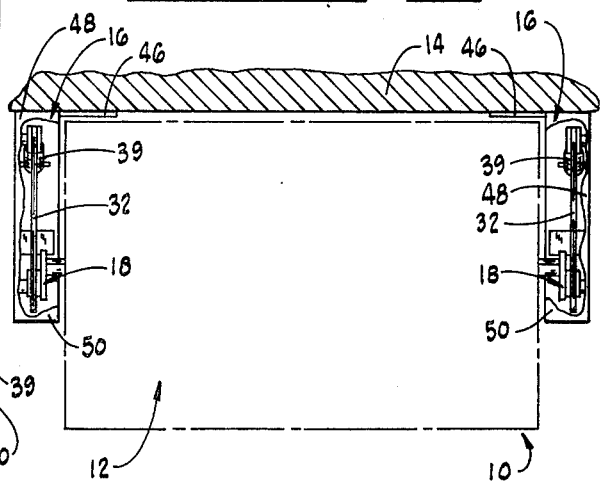
FIG. 4 is a top view of the up-down cabinet with the cabinet housing in a retracted position.

In FIG. 4 a top view of the up-down cabinet 10 is seen with the housing 12 in a retracted position with a portion of an upper flange 50 of the assembly plates 16 cut away to expose the upper swing arm 18. In this view the first side portion 46 of the assembly plates 16 can be seen disposed against and attached to the wall 14.

Changes may be made in the construction and arrangement of the parts or elements of the embodiment as disclosed herein without departing from the spirit or scope of the invention as defined in the following claims.

I claim:

1. An up-down cabinet for lowering a cabinet and retracting the cabinet to its original position, the cabinet comprising:

a cabinet housing having a front, back, and sides, the back of said housing disposed adjacent a wall;

"L" shaped elongated assembly plates, said plates having a first side portion and a second side portion, the first side portion vertically disposed and attached to the wall, the second side portion vertically disposed and parallel the sides of said housing;

stops attached to the second side portion of said plates and extending outwardly toward the sides of said housing;

upper and lower flange portions attached to and perpendicular to the top and bottom of the first and second side portions of said plates;

upper swing arms and lower swing arms vertically disposed between the sides of said housing and the second side portion of said plates, the lower end of said arms attached to the second side portion of said plates, the upper end of said arms attached to the sides of said housing, said arms resting against said stops when the cabinet is raised in a retracted position, said lower swing arms resting against the lower flange portion of said plates when the cabinet is lowered;

cables having cable pivots attached at one end to said lower swing arms;

first cable pulleys attached to the top of the second side portion of said plates, and second cable pulleys attached to said upper swing arms, said cables riding on said first and second cable pulleys; and vertically disposed coil springs, the lower end of said springs attached to a spring mounting plate at the bottom of the second side portion of said plates, the upper end of said springs attached to a spring eye, said spring eye attached to the other end of said cables, said coil springs biasing said cabinet in an upward position and adjacent the wall.

* * * * *